US008231336B2

(12) United States Patent
Maier et al.

(10) Patent No.: US 8,231,336 B2
(45) Date of Patent: Jul. 31, 2012

(54) FLUID DEFLECTOR FOR FLUID SEPARATOR DEVICES

(75) Inventors: William C. Maier, Almond, NY (US); Gocha T. Chochua, Olean, NY (US)

(73) Assignee: Dresser-Rand Company, Olean, NY (US)

( * ) Notice: Subject to any disclaimer, the term of this patent is extended or adjusted under 35 U.S.C. 154(b) by 723 days.

(21) Appl. No.: 12/442,629

(22) PCT Filed: Sep. 25, 2007

(86) PCT No.: PCT/US2007/020659
§ 371 (c)(1),
(2), (4) Date: Mar. 24, 2009

(87) PCT Pub. No.: WO2008/039446
PCT Pub. Date: Apr. 3, 2008

(65) Prior Publication Data

US 2010/0021292 A1 Jan. 28, 2010

Related U.S. Application Data

(60) Provisional application No. 60/847,010, filed on Sep. 25, 2006.

(51) Int. Cl.
*F03B 11/02* (2006.01)

(52) U.S. Cl. ..... 415/121.2; 415/208.1

(58) Field of Classification Search ..... 415/121.2, 415/208.1
See application file for complete search history.

(56) References Cited

U.S. PATENT DOCUMENTS

| | | | |
|---|---|---|---|
| 815,812 | A | 3/1906 | Gow |
| 1,057,613 | A | 4/1913 | Baldwin |
| 1,061,656 | A | 5/1913 | Black |
| 1,480,775 | A | 1/1924 | Marien |
| 1,622,768 | A | 3/1927 | Cook et al. |
| 1,642,454 | A | 9/1927 | Malmstrom |
| 2,006,244 | A | 6/1935 | Kopsa |
| 2,300,766 | A | 11/1942 | Baumann |

(Continued)

FOREIGN PATENT DOCUMENTS

CA 2647511 10/2007

(Continued)

OTHER PUBLICATIONS

PCT/US2007/008149 International Preliminary Report on Patentability dated Sep. 30, 2008.

(Continued)

*Primary Examiner* — Igor Kershteyn
(74) *Attorney, Agent, or Firm* — Edmonds & Nolte, PC

(57) ABSTRACT

A fluid deflector is for a fluid separator including a central axis and an enclosed wall having an open end and an inner circumferential separation surface extending about the axis to define an interior separation chamber. The fluid deflector includes a base disposable proximal to the wall open end and having a central axis collinear with the separator axis. A plurality of vanes are connected with the base so as to be spaced circumferentially about the central axis. The vanes define a plurality of flow channels each bounded by a separate pair of adjacent vanes and having an inlet and an outlet. Each vane directs flow through a bounded channel generally radially inwardly from the channel inlet toward the channel outlet and generally circumferentially and radially outwardly from the channel outlet.

20 Claims, 11 Drawing Sheets

U.S. PATENT DOCUMENTS

| | | | |
|---|---|---|---|
| 2,328,031 | A | 8/1943 | Risley |
| 2,345,437 | A | 3/1944 | Tinker |
| 2,602,462 | A | 7/1952 | Barrett |
| 2,811,303 | A | 10/1957 | Ault et al. |
| 2,836,117 | A | 5/1958 | Lankford |
| 2,868,565 | A | 1/1959 | Suderow |
| 2,897,917 | A | 8/1959 | Hunter |
| 2,932,360 | A | 4/1960 | Hungate |
| 2,954,841 | A | 10/1960 | Reistle |
| 3,044,657 | A | 7/1962 | Horton |
| 3,191,364 | A | 6/1965 | Sylvan |
| 3,198,214 | A | 8/1965 | Lorenz |
| 3,204,696 | A | 9/1965 | De Priester et al. |
| 3,213,794 | A | 10/1965 | Adams |
| 3,220,245 | A | 11/1965 | Van Winkle |
| 3,273,325 | A | 9/1966 | Gerhold |
| 3,352,577 | A | 11/1967 | Medney |
| 3,395,511 | A | 8/1968 | Akerman |
| 3,420,434 | A | 1/1969 | Swearingen |
| 3,431,747 | A | 3/1969 | Hashemi et al. |
| 3,454,163 | A | 7/1969 | Read |
| 3,487,432 | A | 12/1969 | Jenson |
| 3,490,209 | A | 1/1970 | Fernandes et al. |
| 3,500,614 | A | 3/1970 | Soo |
| 3,578,342 | A | 5/1971 | Satterthwaite et al. |
| 3,628,812 | A | 12/1971 | Larraide et al. |
| 3,672,733 | A | 6/1972 | Arsenius et al. |
| 3,814,486 | A | 6/1974 | Schurger |
| 3,829,179 | A | 8/1974 | Kurita et al. |
| 3,915,673 | A | 10/1975 | Tamai et al. |
| 3,975,123 | A | 8/1976 | Schibbye |
| 4,033,647 | A | 7/1977 | Beavers |
| 4,059,364 | A | 11/1977 | Anderson et al. |
| 4,078,809 | A | 3/1978 | Garrick et al. |
| 4,087,261 | A | 5/1978 | Hays |
| 4,103,899 | A | 8/1978 | Turner |
| 4,112,687 | A | 9/1978 | Dixon |
| 4,117,359 | A | 9/1978 | Wehde |
| 4,135,542 | A | 1/1979 | Chisholm |
| 4,141,283 | A | 2/1979 | Swanson et al. |
| 4,146,261 | A | 3/1979 | Edmaier et al. |
| 4,165,622 | A | 8/1979 | Brown, Jr. |
| 4,174,925 | A | 11/1979 | Pfenning et al. |
| 4,182,480 | A | 1/1980 | Theyse et al. |
| 4,197,990 | A | 4/1980 | Carberg et al. |
| 4,205,927 | A | 6/1980 | Simmons |
| 4,227,373 | A | 10/1980 | Amend et al. |
| 4,258,551 | A | 3/1981 | Ritzi |
| 4,259,045 | A | 3/1981 | Teruyama |
| 4,278,200 | A | 7/1981 | Gunnewig |
| 4,298,311 | A | 11/1981 | Ritzi |
| 4,333,748 | A | 6/1982 | Erickson |
| 4,334,592 | A | 6/1982 | Fair |
| 4,336,693 | A | 6/1982 | Hays et al. |
| 4,339,923 | A | 7/1982 | Hays et al. |
| 4,347,900 | A | 9/1982 | Barrington |
| 4,363,608 | A | 12/1982 | Mulders |
| 4,374,583 | A | 2/1983 | Barrington |
| 4,375,975 | A | 3/1983 | McNicholas |
| 4,382,804 | A | 5/1983 | Mellor |
| 4,384,724 | A | 5/1983 | Derman et al. |
| 4,391,102 | A | 7/1983 | Studhalter et al. |
| 4,396,361 | A | 8/1983 | Fraser |
| 4,432,470 | A | 2/1984 | Sopha |
| 4,438,638 | A | 3/1984 | Hays et al. |
| 4,441,322 | A | 4/1984 | Ritzi |
| 4,442,925 | A | 4/1984 | Fukushima et al. |
| 4,453,893 | A | 6/1984 | Hutmaker |
| 4,463,567 | A | 8/1984 | Amend et al. |
| 4,468,234 | A | 8/1984 | McNicholas |
| 4,471,795 | A | 9/1984 | Linhardt |
| 4,477,223 | A | 10/1984 | Giroux |
| 4,502,839 | A | 3/1985 | Maddox et al. |
| 4,511,309 | A | 4/1985 | Maddox |
| 4,531,888 | A | 7/1985 | Buchelt |
| 4,536,134 | A | 8/1985 | Huiber |
| 4,541,531 | A | 9/1985 | Brule |
| 4,541,607 | A | 9/1985 | Hotger |
| 4,573,527 | A | 3/1986 | McDonough |
| 4,574,815 | A | 3/1986 | West et al. |
| 4,648,806 | A | 3/1987 | Alexander |
| 4,687,017 | A | 8/1987 | Danko et al. |
| 4,737,081 | A | 4/1988 | Nakajima et al. |
| 4,752,185 | A | 6/1988 | Butler et al. |
| 4,807,664 | A | 2/1989 | Wilson et al. |
| 4,813,495 | A | 3/1989 | Leach |
| 4,821,737 | A | 4/1989 | Nelson |
| 4,826,403 | A | 5/1989 | Catlow |
| 4,830,331 | A | 5/1989 | Vindum |
| 4,832,709 | A | 5/1989 | Nagyszalanczy |
| 4,904,284 | A | 2/1990 | Hanabusa |
| 4,984,830 | A | 1/1991 | Saunders |
| 5,007,328 | A | 4/1991 | Otterman |
| 5,024,585 | A | 6/1991 | Kralovec |
| 5,043,617 | A | 8/1991 | Rostron |
| 5,044,701 | A | 9/1991 | Watanabe et al. |
| 5,045,046 | A | 9/1991 | Bond |
| 5,054,995 | A | 10/1991 | Haseley et al. |
| 5,064,452 | A | 11/1991 | Yano et al. |
| 5,080,137 | A | 1/1992 | Adams |
| 5,190,440 | A | 3/1993 | Maier et al. |
| 5,202,024 | A | 4/1993 | Andersson et al. |
| 5,202,026 | A | 4/1993 | Lema |
| 5,203,891 | A | 4/1993 | Lema |
| 5,207,810 | A | 5/1993 | Sheth |
| 5,211,427 | A | 5/1993 | Washizu |
| 5,246,346 | A | 9/1993 | Schiesser |
| 5,285,123 | A | 2/1994 | Kataoka et al. |
| 5,306,051 | A | 4/1994 | Loker et al. |
| 5,337,779 | A | 8/1994 | Fukuhara |
| 5,378,121 | A | 1/1995 | Hackett |
| 5,385,446 | A | 1/1995 | Hays |
| 5,421,708 | A | 6/1995 | Utter |
| 5,443,581 | A | 8/1995 | Malone |
| 5,484,521 | A | 1/1996 | Kramer |
| 5,496,394 | A | 3/1996 | Nied |
| 5,500,039 | A | 3/1996 | Mori et al. |
| 5,525,034 | A | 6/1996 | Hays |
| 5,525,146 | A | 6/1996 | Straub |
| 5,531,811 | A | 7/1996 | Kloberdanz |
| 5,538,259 | A | 7/1996 | Uhrner et al. |
| 5,542,831 | A | 8/1996 | Scarfone |
| 5,575,309 | A | 11/1996 | Connell |
| 5,585,000 | A | 12/1996 | Sassi |
| 5,605,172 | A | 2/1997 | Schubert et al. |
| 5,628,623 | A | 5/1997 | Skaggs |
| 5,634,492 | A | 6/1997 | Steinruck et al. |
| 5,640,472 | A | 6/1997 | Meinzer et al. |
| 5,641,280 | A | 6/1997 | Timuska |
| 5,653,347 | A | 8/1997 | Larsson |
| 5,664,420 | A | 9/1997 | Hays |
| 5,682,759 | A | 11/1997 | Hays |
| 5,683,235 | A | 11/1997 | Welch |
| 5,685,691 | A | 11/1997 | Hays |
| 5,687,249 | A | 11/1997 | Kato |
| 5,693,125 | A | 12/1997 | Dean |
| 5,703,424 | A | 12/1997 | Dorman |
| 5,709,528 | A | 1/1998 | Hablanian |
| 5,713,720 | A | 2/1998 | Barhoum |
| 5,720,799 | A | 2/1998 | Hays |
| 5,750,040 | A | 5/1998 | Hays |
| 5,775,882 | A | 7/1998 | Kiyokawa et al. |
| 5,779,619 | A | 7/1998 | Borgstrom et al. |
| 5,795,135 | A | 8/1998 | Nyilas et al. |
| 5,800,092 | A | 9/1998 | Nill et al. |
| 5,848,616 | A | 12/1998 | Vogel et al. |
| 5,850,857 | A | 12/1998 | Simpson |
| 5,853,585 | A | 12/1998 | Nesseth |
| 5,863,023 | A | 1/1999 | Evans et al. |
| 5,899,435 | A | 5/1999 | Mitsch et al. |
| 5,935,053 | A | 8/1999 | Strid |
| 5,938,803 | A | 8/1999 | Dries |
| 5,938,819 | A | 8/1999 | Seery |
| 5,946,915 | A | 9/1999 | Hays |
| 5,951,066 | A | 9/1999 | Lane et al. |
| 5,965,022 | A | 10/1999 | Gould |
| 5,967,746 | A | 10/1999 | Hagi et al. |

5,971,702 A 10/1999 Afton et al.
5,971,907 A 10/1999 Johannemann et al.
5,980,218 A 11/1999 Takahashi et al.
5,988,524 A 11/1999 Odajima et al.
6,035,934 A 3/2000 Stevenson et al.
6,059,539 A 5/2000 Nyilas et al.
6,068,447 A 5/2000 Foege
6,090,174 A 7/2000 Douma et al.
6,090,299 A 7/2000 Hays et al.
6,113,675 A 9/2000 Branstetter
6,122,915 A 9/2000 Hays
6,123,363 A 9/2000 Burgard et al.
6,145,844 A 11/2000 Waggott
6,149,825 A 11/2000 Gargas
6,151,881 A 11/2000 Ai et al.
6,156,193 A * 12/2000 Meinhold et al. ..... 210/167.02
6,196,962 B1 3/2001 Purvey et al.
6,206,202 B1 3/2001 Galk et al.
6,214,075 B1 4/2001 Filges et al.
6,217,637 B1 4/2001 Toney et al.
6,227,379 B1 5/2001 Nesseth
6,277,278 B1 8/2001 Conrad et al.
6,312,021 B1 11/2001 Thomas
6,314,738 B1 11/2001 Hays
6,372,006 B1 4/2002 Pregenzer et al.
6,375,437 B1 4/2002 Nolan
6,383,262 B1 5/2002 Marthinsen et al.
6,394,764 B1 5/2002 Samurin
6,398,973 B1 6/2002 Saunders et al.
6,402,465 B1 6/2002 Maier
6,426,010 B1 7/2002 Lecoffre et al.
6,464,469 B1 10/2002 Grob et al.
6,467,988 B1 10/2002 Czachor et al.
6,468,426 B1 10/2002 Klass
6,485,536 B1 11/2002 Masters
6,530,484 B1 3/2003 Bosman
6,530,979 B2 3/2003 Firey
6,531,066 B1 3/2003 Saunders et al.
6,537,035 B2 3/2003 Shumway
6,540,917 B1 4/2003 Rachels et al.
6,547,037 B2 4/2003 Kuzdzal
6,592,654 B2 7/2003 Brown
6,596,046 B2 7/2003 Conrad et al.
6,599,086 B2 7/2003 Soja
6,607,348 B2 8/2003 Jean
6,616,719 B1 9/2003 Sun et al.
6,617,731 B1 9/2003 Goodnick
6,629,825 B2 10/2003 Stickland et al.
6,631,617 B1 10/2003 Dreiman et al.
6,658,986 B2 12/2003 Pitla et al.
6,659,143 B1 12/2003 Taylor et al.
6,669,845 B2 12/2003 Klass
6,688,802 B2 2/2004 Ross et al.
6,707,200 B2 3/2004 Carroll et al.
6,718,955 B1 4/2004 Knight
6,719,830 B2 4/2004 Illingworth et al.
6,764,284 B2 7/2004 Oehman, Jr.
6,776,812 B2 8/2004 Komura et al.
6,802,693 B2 10/2004 Reinfeld et al.
6,802,881 B2 10/2004 Illingworth et al.
6,811,713 B2 11/2004 Arnaud
6,817,846 B2 11/2004 Bennitt
6,837,913 B2 1/2005 Schilling et al.
6,843,836 B2 1/2005 Kitchener
6,878,187 B1 4/2005 Hays et al.
6,893,208 B2 5/2005 Frosini et al.
6,907,933 B2 6/2005 Choi et al.
6,979,358 B2 12/2005 Ekker
7,001,448 B1 2/2006 West
7,013,978 B2 3/2006 Appleford et al.
7,022,150 B2 4/2006 Borgstrom et al.
7,022,153 B2 4/2006 McKenzie
7,025,890 B2 4/2006 Moya
7,033,410 B2 4/2006 Hilpert et al.
7,033,411 B2 4/2006 Carlsson et al.
7,056,363 B2 6/2006 Carlsson et al.
7,063,465 B1 6/2006 Wilkes et al.
7,112,036 B2 9/2006 Lubell et al.
7,131,292 B2 11/2006 Ikegami et al.
7,144,226 B2 12/2006 Pugnet et al.
7,159,723 B2 1/2007 Hilpert et al.
7,160,518 B2 1/2007 Chen et al.
7,169,305 B2 1/2007 Gomez
7,185,447 B2 3/2007 Arbeiter
7,204,241 B2 4/2007 Thompson
7,241,392 B2 7/2007 Maier
7,244,111 B2 7/2007 Suter et al.
7,258,713 B2 8/2007 Eubank et al.
7,270,145 B2 9/2007 Koezler
7,288,202 B2 10/2007 Maier
7,314,560 B2 1/2008 Yoshida et al.
7,323,023 B2 1/2008 Michele et al.
7,328,749 B2 2/2008 Reitz
7,335,313 B2 2/2008 Moya
7,337,110 B2 2/2008 Sheridan et al.
7,381,235 B2 6/2008 Koene et al.
7,396,373 B2 7/2008 Lagerstedt et al.
7,399,412 B2 7/2008 Keuschnigg
7,435,290 B2 10/2008 Lane et al.
7,445,653 B2 11/2008 Trautmann et al.
7,470,299 B2 12/2008 Han et al.
7,473,083 B2 1/2009 Oh et al.
7,479,171 B2 1/2009 Cho et al.
7,494,523 B2 2/2009 Oh et al.
7,501,002 B2 3/2009 Han et al.
7,520,210 B2 4/2009 Theodore, Jr. et al.
7,575,422 B2 8/2009 Bode et al.
7,578,863 B2 8/2009 Becker et al.
7,591,882 B2 9/2009 Harazim
7,594,941 B2 9/2009 Zheng et al.
7,594,942 B2 9/2009 Polderman
7,610,955 B2 11/2009 Irwin, Jr.
7,628,836 B2 12/2009 Baronet et al.
7,637,699 B2 12/2009 Albrecht
7,674,377 B2 3/2010 Crew
7,677,308 B2 3/2010 Kolle
7,708,537 B2 5/2010 Bhatia et al.
7,708,808 B1 5/2010 Heumann
7,744,663 B2 6/2010 Wallace
7,748,079 B2 7/2010 McDowell et al.
7,766,989 B2 8/2010 Lane et al.
7,811,344 B1 10/2010 Duke et al.
7,811,347 B2 10/2010 Carlsson et al.
7,815,415 B2 10/2010 Kanezawa et al.
7,824,458 B2 11/2010 Borgstrom et al.
7,824,459 B2 11/2010 Borgstrom et al.
7,846,228 B1 12/2010 Saaski et al.
2001/0007283 A1 7/2001 Johal et al.
2002/0009361 A1 1/2002 Reichert et al.
2003/0029318 A1 2/2003 Firey
2003/0035718 A1 2/2003 Langston et al.
2003/0136094 A1 7/2003 Illingworth et al.
2004/0007261 A1 1/2004 Cornwell
2004/0170505 A1 9/2004 Lenderink et al.
2005/0173337 A1 8/2005 Costinel
2006/0065609 A1 3/2006 Arthur
2006/0090430 A1 5/2006 Trautman et al.
2006/0096933 A1 5/2006 Maier
2006/0157251 A1 7/2006 Stinessen et al.
2006/0157406 A1 7/2006 Maier
2006/0193728 A1 8/2006 Lindsey et al.
2006/0222515 A1 10/2006 Delmotte et al.
2006/0230933 A1 10/2006 Harazim
2006/0239831 A1 10/2006 Garris, Jr.
2006/0254659 A1 11/2006 Ballot et al.
2006/0275160 A1 12/2006 Leu et al.
2007/0029091 A1 2/2007 Stinessen et al.
2007/0036646 A1 2/2007 Nguyen et al.
2007/0051245 A1 3/2007 Yun
2007/0062374 A1 3/2007 Kolle
2007/0065317 A1 3/2007 Stock
2007/0084340 A1 4/2007 Dou et al.
2007/0140870 A1 6/2007 Fukanuma et al.
2007/0151922 A1 7/2007 Mian
2007/0163215 A1 7/2007 Lagerstadt
2007/0172363 A1 7/2007 Laboube et al.
2007/0196215 A1 8/2007 Frosini et al.
2007/0227969 A1 10/2007 Dehaene et al.

| | | | |
|---|---|---|---|
| 2007/0294986 | A1 | 12/2007 | Beetz |
| 2008/0031732 | A1 | 2/2008 | Peer et al. |
| 2008/0039732 | A9 | 2/2008 | Bowman |
| 2008/0246281 | A1 | 10/2008 | Agrawal et al. |
| 2008/0315812 | A1 | 12/2008 | Balboul |
| 2009/0013658 | A1 | 1/2009 | Borgstrom et al. |
| 2009/0015012 | A1 | 1/2009 | Metzler et al. |
| 2009/0025562 | A1 | 1/2009 | Hallgren et al. |
| 2009/0025563 | A1 | 1/2009 | Borgstrom et al. |
| 2009/0151928 | A1 | 6/2009 | Lawson |
| 2009/0159523 | A1 | 6/2009 | McCutchen |
| 2009/0169407 | A1 | 7/2009 | Yun |
| 2009/0173095 | A1 | 7/2009 | Bhatia et al. |
| 2009/0266231 | A1 | 10/2009 | Franzen et al. |
| 2009/0304496 | A1 | 12/2009 | Maier |
| 2009/0321343 | A1 | 12/2009 | Maier |
| 2009/0324391 | A1 | 12/2009 | Maier |
| 2010/0007133 | A1 | 1/2010 | Maier |
| 2010/0021292 | A1 | 1/2010 | Maier et al. |
| 2010/0038309 | A1 | 2/2010 | Maier |
| 2010/0043288 | A1 | 2/2010 | Wallace |
| 2010/0043364 | A1 | 2/2010 | Curien |
| 2010/0044966 | A1 | 2/2010 | Majot et al. |
| 2010/0072121 | A1 | 3/2010 | Maier |
| 2010/0074768 | A1 | 3/2010 | Maier |
| 2010/0083690 | A1 | 4/2010 | Sato et al. |
| 2010/0090087 | A1 | 4/2010 | Maier |
| 2010/0143172 | A1 | 6/2010 | Sato et al. |
| 2010/0163232 | A1 | 7/2010 | Kolle |
| 2010/0183438 | A1 | 7/2010 | Maier et al. |
| 2010/0239419 | A1 | 9/2010 | Maier et al. |
| 2010/0239437 | A1 | 9/2010 | Maier |
| 2010/0247299 | A1 | 9/2010 | Maier |
| 2010/0257827 | A1 | 10/2010 | Lane et al. |
| 2011/0017307 | A1 | 1/2011 | Kidd et al. |
| 2011/0061536 | A1 | 3/2011 | Maier et al. |

FOREIGN PATENT DOCUMENTS

| | | | |
|---|---|---|---|
| EP | 301285 | | 10/1991 |
| EP | 1582703 | | 10/2005 |
| EP | 2013479 | | 1/2009 |
| EP | 7838631.5 | | 12/2009 |
| GB | 2323639 | | 9/1998 |
| GB | 2337561 | | 11/1999 |
| JP | 54099206 | | 1/1978 |
| JP | 08 068501 | | 3/1996 |
| JP | 8-284961 | A | 11/1996 |
| JP | 2002 242699 | | 8/2002 |
| JP | 2004034017 | A | 2/2004 |
| JP | 3711028 | | 10/2005 |
| JP | 2005291202 | | 10/2005 |
| KR | 2009085521 | | 2/2008 |
| MX | 2008012579 | | 12/2008 |
| WO | 9524563 | | 9/1995 |
| WO | 0117096 | | 3/2001 |
| WO | 2007043889 | | 4/2007 |
| WO | 2007103248 | | 9/2007 |
| WO | 2007120506 | | 10/2007 |
| WO | 2008036221 | | 3/2008 |
| WO | 2008039446 | | 3/2008 |
| WO | 2008039491 | | 4/2008 |
| WO | 2008039731 | | 4/2008 |
| WO | 2008039732 | | 4/2008 |
| WO | 2008039733 | | 4/2008 |
| WO | 2008039734 | | 4/2008 |
| WO | 2008036394 | | 7/2008 |
| WO | 2009111616 | | 6/2009 |
| WO | 2009158252 | | 12/2009 |
| WO | 2009158253 | | 12/2009 |
| WO | 2010083416 | | 7/2010 |
| WO | 2010083427 | | 7/2010 |
| WO | 2010107579 | | 9/2010 |
| WO | 2010110992 | | 9/2010 |
| WO | 2011034764 | | 3/2011 |

OTHER PUBLICATIONS

PCT/US2007/008149 International Search Report and Written Opinion dated Jul. 17, 2008.
PCT/US2007/020101 International Preliminary Report on Patentability dated Apr. 2, 2009.
PCT/US2007/020101 International Search Report dated Apr. 29, 2008.
PCT/US2007/020101 Written Opinion dated Mar. 19, 2009.
PCT/US2007/020471 International Preliminary Report on Patentability dated Apr. 2, 2009.
PCT/US2007/020471 International Search Report and Written Opinion dated Apr. 1, 2008.
PCT/US2007/020659 International Preliminary Report on Patentability dated Mar. 31, 2009.
PCT/US2007/020659 International Search Report and Written Opinion dated Sep. 17, 2008.
PCT/US2007/020768 International Preliminary Report on Patentability dated Mar. 31, 2009.
PCT/US2007/020768 International Search Report and Written Opinion dated Mar. 3, 2008.
PCT/US2007/079348 International Preliminary Report on Patentability dated Mar. 31, 2009.
PCT/US2007/079348 International Search Report dated Apr. 11, 2008.
PCT/US2007/079348 Written Opinion dated Jan. 25, 2008.
PCT/US2007/079349 International Preliminary Report on Patentability dated Mar. 31, 2009.
PCT/US2007/079349 International Search Report and Written Opinion dated Apr. 2, 2008.
PCT/US2007/079350 International Preliminary Report on Patentability dated Mar. 31, 2009.
PCT/US2007/079350 International Search Report dated Jul. 17, 2008.
PCT/US2007/079350 Written Opinion dated Mar. 25, 2009.
PCT/US2007/079352 International Preliminary Report on Patentability dated Mar. 31, 2009.
PCT/US2007/079352 International Search Report and Written Opinion dated Aug. 27, 2008.
PCT/US2009/036142 International Preliminary Report on Patentability dated Sep. 16, 2010.
PCT/US2009/036142 International Search Report dated Jan. 7, 2010.
PCT/US2009/036142 Written Opinion dated May 11, 2009.
PCT/US2009/047662 International Preliminary Report on Patentability dated Jan. 13, 2011.
PCT/US2009/047662 Written Opinion dated Aug. 20, 2009.
PCT/US2010/021199 International Search Report and Written Opinion dated Mar. 22, 2010.
PCT/US2010/021199 International Preliminary Report on Patentability dated Mar. 29, 2011.
PCT/US2010/021218 International Search Report and Written Opinion dated Mar. 23, 2010.
PCT/US2010/021218 International Report on Patentability dated Feb. 2, 2011.
PCT/US2010/025650 International Search Report and Written Opinion dated Apr. 22, 2010.
PCT/US2010/025650 International Report on Patentability dated Mar. 14, 2011.
PCT/US2010/025952 International Search Report and Written Opinion dated Apr. 12, 2010.
PCT/US2010/025952 International Report on Patentability dated Mar. 14, 2011.
PCT/US2009/047667 International Report on Patentability dated Jan. 13, 2011.
PCT/US2009/047667 Written Opinion dated Aug. 7, 2009.
PCT/US2009/047667 International Search Report dated Dec. 30, 2009.
Dresser-Rand, Inc. "High Pressure Air Compressor Model 13NL45," Oct. 28, 1991, 14 pages.
International Search Report for Patent Cooperation Treaty Application No. PCT/US2007/020659, dated Sep. 17, 2008, pp. 1-3.
Technical Manual—High Pressure Air Compressor Model 13NL45; Navsea S6220-AT-MMA-010/93236, pp. 3-23 to 3-32, Electric Boat Corporation, Groton, CT 06340, Oct. 28, 1991.

* cited by examiner

FLUID DEFLECTOR FOR FLUID SEPARATOR DEVICES

CROSS REFERENCE

This application is a United States national phase application of co-pending international patent application No. PCT/US2007/020659, filed Sep. 25, 2007, which claims priority to U.S. patent application Ser. No. 60/847,010, filed Sep. 25, 2006, the disclosures of which are incorporated herein by reference.

The present invention relates to fluid machinery, and more particularly to combination separator and compressor devices.

Centrifugal compressors are known and typically include one or more impellers mounted on a driven shaft and configured to pressurize gas drawn into a central inlet and to discharge the fluid radially outwardly through one or more outlets located at an outer circumferential perimeter thereof. In order to properly function, only gas should be directed into the compressor inlet, such that any liquids should be removed from a fluid stream prior to entry into the compressor. As such, compressors are often used in conjunction with a separator device to remove liquids from the fluid stream prior to entry into the compressor inlet.

Referring to FIG. 1, one type of separator is a static separator S that uses swirler vanes V in conjunction with a separation surface SS bounding an interior separation chamber C. The swirler vanes V cause a fluid stream F to generally swirl or rotate after passing therethrough in order to initiate the radial outward movement of heavier liquid particles. Typically, such swirler vanes V are formed as plurality of relatively short, substantially radially aligned plates, such that a radial gap G is defined between adjacent vanes V. After passing through the vanes V, the flow is directed or deflected by means of contact with a static member M of the compressor assembly (e.g., a diaphragm wall) and/or a rotary member R (e.g., a rotary separator drum) so as to flow within the separation chamber C. The liquid particles contacting the separation surface SS are separated out of the fluid stream for subsequent collection.

Although such static separators are generally effective, such devices function less than ideally under certain operating characteristics. Specifically, when there are concentrated portions of liquid within the fluid stream, these liquid portions may pass directly between the radial vanes V without being entrained within the swirled fluid stream for conveyance toward the separation surface as intended.

SUMMARY OF THE INVENTION

In one aspect, the present invention is a fluid deflector for a fluid separator, the separator including a central axis and a generally enclosed wall having an open end and an inner circumferential separation surface extending circumferentially about the axis so as to define an interior separation chamber. The fluid deflector comprises a base disposeable generally proximal to the wall open end and having a central axis, the base axis being at least generally collinear with the separator axis. A plurality of vanes are connected with the base so as to be spaced circumferentially about the central axis. Each vane is configured to direct fluid contacting the vane at least generally radially outwardly toward the wall separation surface.

In another aspect, the present invention is a fluid separator comprising a housing having an interior chamber and an inlet passage extending into the chamber, a wall disposed within the housing chamber and having an end surface and an inner circumferential surface at least partially defining a separation chamber, and a fluid deflector. The fluid deflector is disposed within the housing chamber and includes a base with a central axis, the base being spaced from the wall end surface so as to define a generally radial part configured to fluidly connect the inlet passage with the separation chamber, and a plurality of vanes connected with the base. The vanes are spaced circumferentially about the central axis and each vane is configured to direct fluid contacting the vane generally toward the wall inner surface. As such, at least a portion liquid and/or relatively dense gas within fluid that is directed onto the wall inner surface is separated from the fluid.

In a further aspect, the present invention is a compressor comprising a casing having an interior chamber and an inlet passage extending into the chamber, a shaft disposed within the casing chamber so as to be rotatable about a central axis, and a least one impeller mounted on the shaft. An enclosed wall is disposed within casing chamber and has an end surface and an inner surface extending circumferentially about the axis and spaced radially outwardly from the shaft. The wall inner surface at least partially defines a separation chamber. Further, a fluid deflector is disposed within the housing chamber generally between the wall end surface and the impeller. The deflector includes a base with a central axis, the base being spaced from the wall end surface so as to define a generally radial port configured to fluidly connect the inlet passage with the separation chamber. A plurality of vanes are connected with the base and are spaced circumferentially about the central axis. Each vane is configured to direct fluid contacting the vane generally toward the wall inner surface such that at least a portion of liquid and/or relatively dense gas within fluid directed onto the wall inner surface is separated from the fluid.

BRIEF DESCRIPTION OF THE SEVERAL VIEWS OF THE DRAWINGS

The foregoing summary, as well as the detailed description of the preferred embodiments of the present invention, will be better understood when read in conjunction with the appended drawings. For the purpose of illustrating the invention, there is shown in the drawings, which are diagrammatic, embodiments that are presently preferred. It should be understood, however, that the present invention is not limited to the precise arrangements and instrumentalities shown. In the drawings.

DETAILED DESCRIPTION OF THE INVENTION

Figure 1:
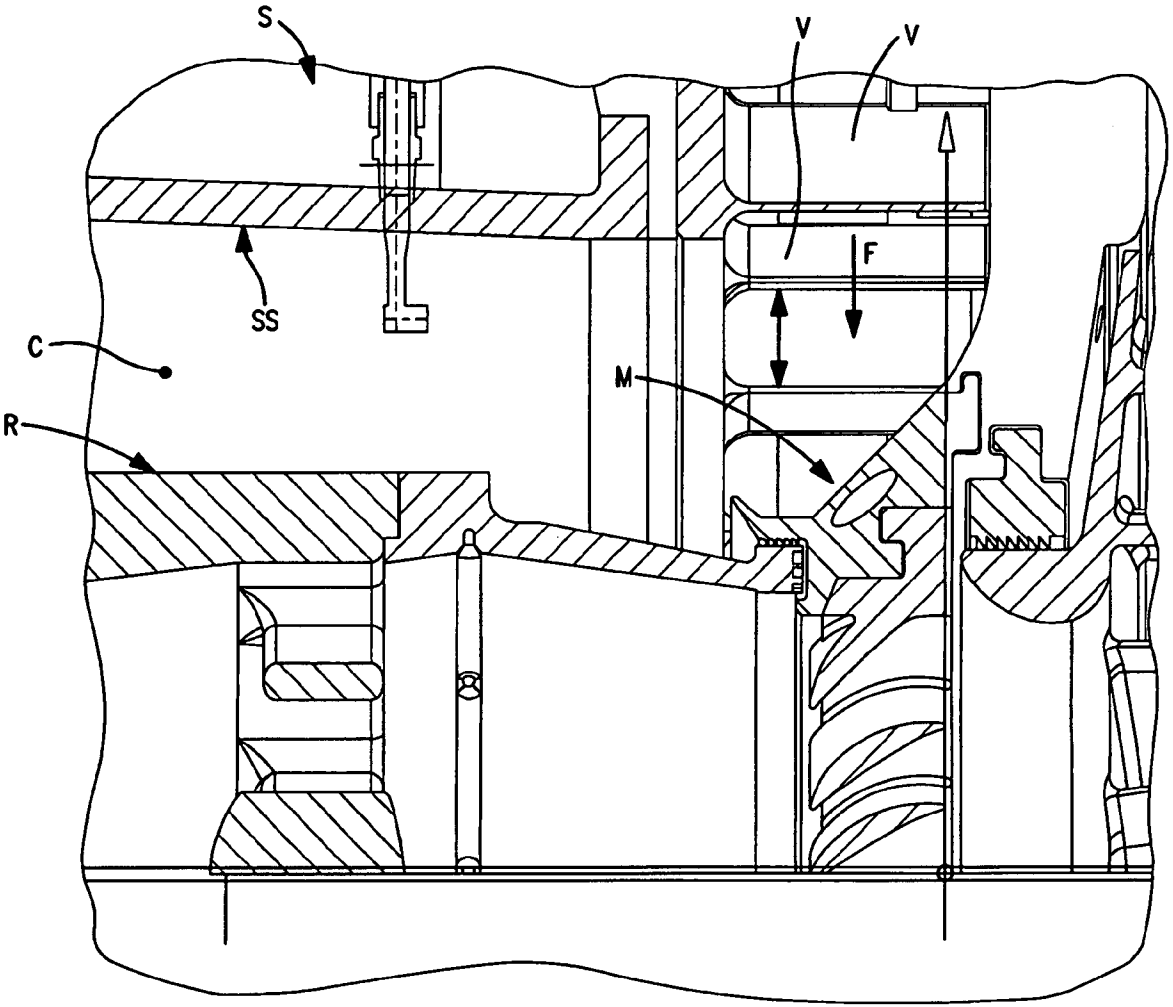
FIG. 1 is a broken-away, axial cross-sectional view of a prior art static separator device of a combination separator compressor device, showing a known swirl device.

Certain terminology is used in the following description for convenience only and is not limiting. The words "right", left", "lower", "upper", "upward", "down" and "downward" designate directions in the drawings to which reference is made. The words "inner", "inwardly" and "outer", "outwardly" refer to directions toward and away from, respectively, a designated centerline or a geometric center of an element being described, the particular meaning being readily apparent from the context of the description. Further, as used herein, the word "connected" is intended to include direct connections between two members without any other members interposed therebetween and indirect connections between members in which one or more other members are interposed therebetween. The terminology includes the words specifically mentioned above, derivatives thereof, and words of similar import.

Referring now to the drawings in detail, wherein like numbers are used to indicate like elements throughout, there is shown in FIGS. 1-16 a fluid deflector 10 for a fluid separator 12. The separator 12 includes a central axis 11 and generally enclosed wall 14 with at least one open, inlet end 15 with an end surface 15*a* and an inner circumferential separation surface 16. The separation surface 16 extends circumferentially about the axis 11 so as to define an interior separation chamber 17. The separator 12 is preferably installed within, or is a subassembly of, a compressor 1 as discussed below, but may alternatively be a "stand alone" fluid separation device. The fluid deflector 10 basically comprises a base 20 and a plurality of vanes 22 connected with the base 20. The base 20 is disposeable proximal to the wall open end 15 and has a central axis 21, the base axis 21 being at least generally collinear with separator axis 11 when the base 20 is positioned as intended. The plurality of vanes 22 are connected with the base 20 so as to be spaced circumferentially about the central axis 15. Further, each vane 22 is configured to direct fluid contacting the vane 22 at least generally radially outwardly toward the separator wall inner surface/separation surface 16. Thereby, at least a portion of liquid and/or relatively dense gas within a fluid stream F directed onto the wall inner surface 16 is separated from the remaining fluid (i.e., which is substantially gaseous).

More specifically, the base 20 and the plurality of vanes 22 define a plurality of flow channels 24, each flow channel 24 being bounded by a separate one of a plurality of pairs of adjacent vanes 22. Also, each flow channel 24 has an inlet 25 and an outlet 26, as described in further detail below. Each vane 22 is configured to direct flow through at least one channel 24 partially bounded by the vane 22 such that fluid flows generally radially inwardly from the channel inlet 24 toward the channel outlet 26, and then flows generally circumferentially and radially outwardly from the channel outlet 26. That is, each vane 22 is configured to direct fluid contacting the vane 22 to flow at least generally radially outwardly from the outlet 26 from one of the two channels 24 partially bounded by the vane 22, as described in further detail below. Further, the base 20 has an outer surface 23 facing generally toward the separator wall 14 and each vane 22 extends generally outwardly from the base surface 23, each flow channel 24 being partially bounded by a separate one of a plurality of flow surface sections 27 of the base surface 23.

In other words, a plurality of flow surface sections or "flow surfaces" 27 are each defined between a separate pair of adjacent vanes 22 and partially bound a separate one of the flow channels 24. Each flow surface 27 is configured to direct fluid contacting the surface 27 first generally radially inward from the inlet 25 and then radially outwardly from the outlet 26. As such, with the plurality of circumferentially spaced channel outlets 26 each directing a separate fluid stream portion $f_P$ radially outwardly in a separate circumferential and axial, generally spiral-shaped path $P_C$ (see FIG. 9), a swirling fluid stream F is generated within the separator inner chamber 17, causing liquid portions (and/or dense gas portions) of the swirling stream F to be directed onto the separation surface 16 so as to be removed from the fluid stream F prior to flowing out of a chamber outlet 18.

Figure 2:
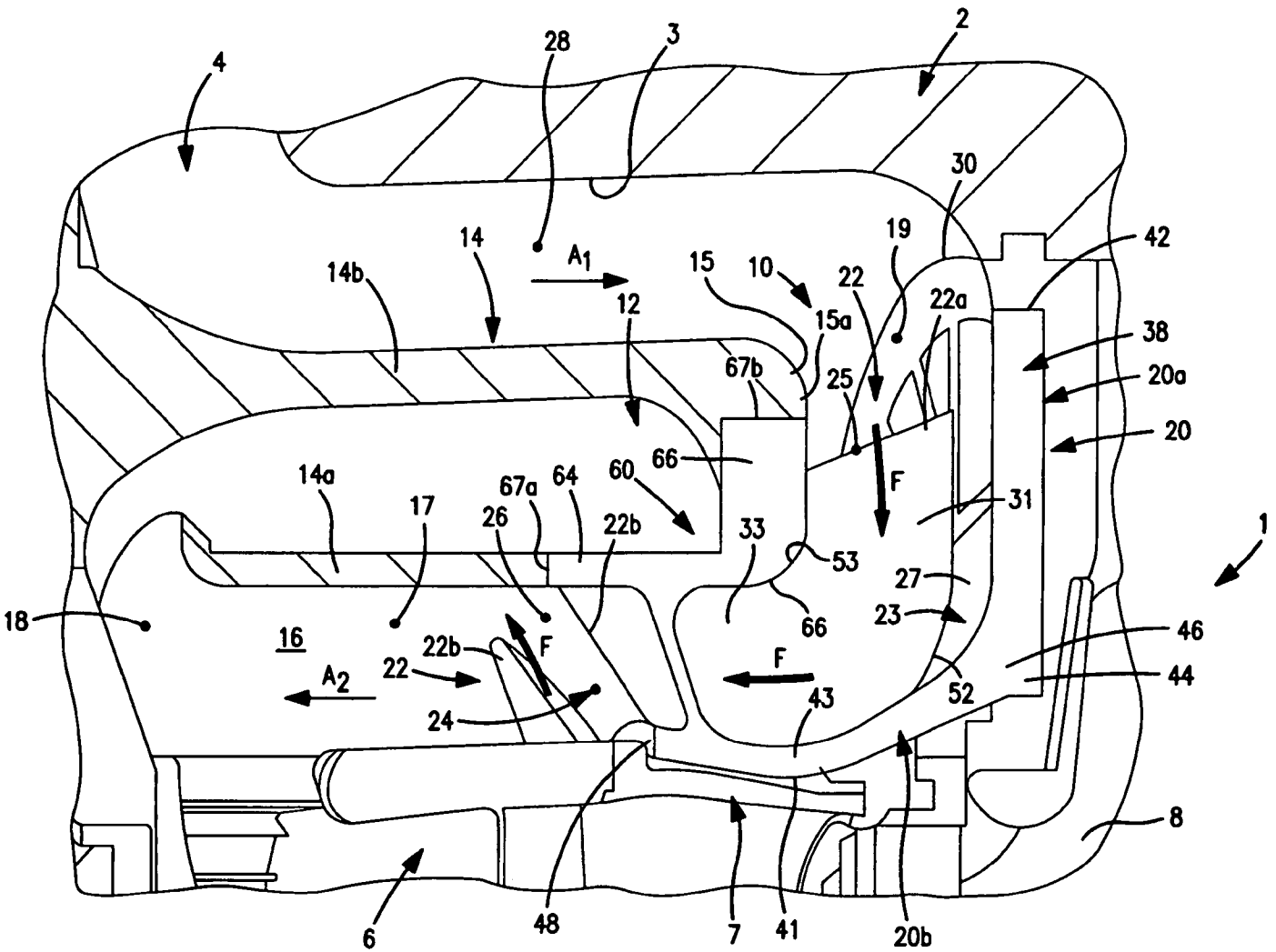
FIG. 2 is a broken-away, axial cross-sectional view of a static separator with a fluid deflector in accordance with the present invention.

Preferably, the separator 12 is incorporated into a compressor 1 that further includes a casing 2 with an interior chamber 3 and an inlet passage 4 extending into the chamber 3. The base 20 is spaced from the separator wall end 15 so as to define a generally radial port 19 configured to fluidly connect the inlet passage 4 with the separation chamber 17. As shown in FIG. 2, the separator enclosed wall 14 preferably includes an inner wall section 14*a* providing the separation surface 16 and a coaxial outer wall section 14*b* spaced radially outwardly from the inner wall section 14*a* and partially defining an annular flow passage section 28 (discussed below) of the inlet passage 4, but may alternatively be formed as a single, radially thicker wall (not shown). Further, the base 20 preferably has an outer, generally radial portion 20*a* spaced from the wall end 15, such that the port 19 is defined between the base radial portion 20*a* and the wall end 15, and an inner, generally axial portion 20*b* extending axially from the radial portion 20*b* so as to be disposed at least partially within the separation chamber 17.

With this structure, each vane 22 preferably has a first or inlet end 22*a* located at least generally proximal to, and preferably disposed within, the flow port 19 and a second or outlet end 22*b* spaced axially and radially inwardly from the first end 22*a* and disposed within the separator interior chamber 17. More specifically, each vane 22 is located with respect to the separator wall 14 such that the vane first end 22*a* is spaced axially outwardly from the separator wall end 15 and the vane second end 22*b* is spaced axially inwardly from the wall end 15. As such, a fluid stream F contacting each vane 22 is directed to flow generally radially inwardly from the vane first end 22*a*, then generally axially into the wall interior chamber 17, and thereafter radially outwardly from the vane second end 22*b* so as to flow both circumferentially and radially outwardly generally toward the wall inner surface 16.

Further, the annular flow passage section 28 of the inlet passage 4 is preferably defined between the casing 2 and the separator wall 14, so as to extend entirely circumferentially about the wall 14, and extends at least generally along the separator axis 11. Also, the base 20 and/or the vanes 22 are configured to deflect fluid F flowing generally in a first axial direction $A_1$ through the annular passage section 28 (and also circumferentially therethrough) to flow generally in an opposing axial direction $A_2$ into the interior chamber 17. Thus, the fluid deflector 10 not only generates swirl within the fluid stream F passing therethrough and directs the liquid portions toward the separation surface 16, but also functions to deflect or channel the fluid stream F to flow axially into the separation chamber 17.

Referring to FIGS. 2-4 and 13, the deflector base 20 has an outer circumferential edge 30 on the base radial portion 20*a*, which extends circumferentially about the axis 21, and each vane 22 has a first, generally radial portion 31 providing the inlet or leading end 22*a* and a second, generally axial portion 33 providing the outlet or trailing end 22*b*. Each vane radial portion 31 is disposed generally proximal to the base outer edge 30 and extends generally radially inwardly from the inlet end 22*a*. Further, each vane axial portion 33 is connected with, and preferably integrally formed with, the associated radial portion 31 and extends generally axially and circumferentially from the first portion 31 to the vane outlet end 22*b*, which is located generally proximal to the base axis 21. Preferably, each vane 22 includes an elongated body 34 with a first section 34*a* providing the radial portion 31, a second section 34*b* providing the axial portion 33, and opposing, curved channeling surfaces 36, 37 extending between the two ends 22*a*, 22*b*. Each channeling surface 36, 37 is configured to direct fluid contacting the vane body 34 proximal to the body first end 22*a* to flow generally radially inwardly and then simultaneously generally axially and generally radially outwardly beyond the vane second end 22*b*, as described in greater detail below.

Figure 13:
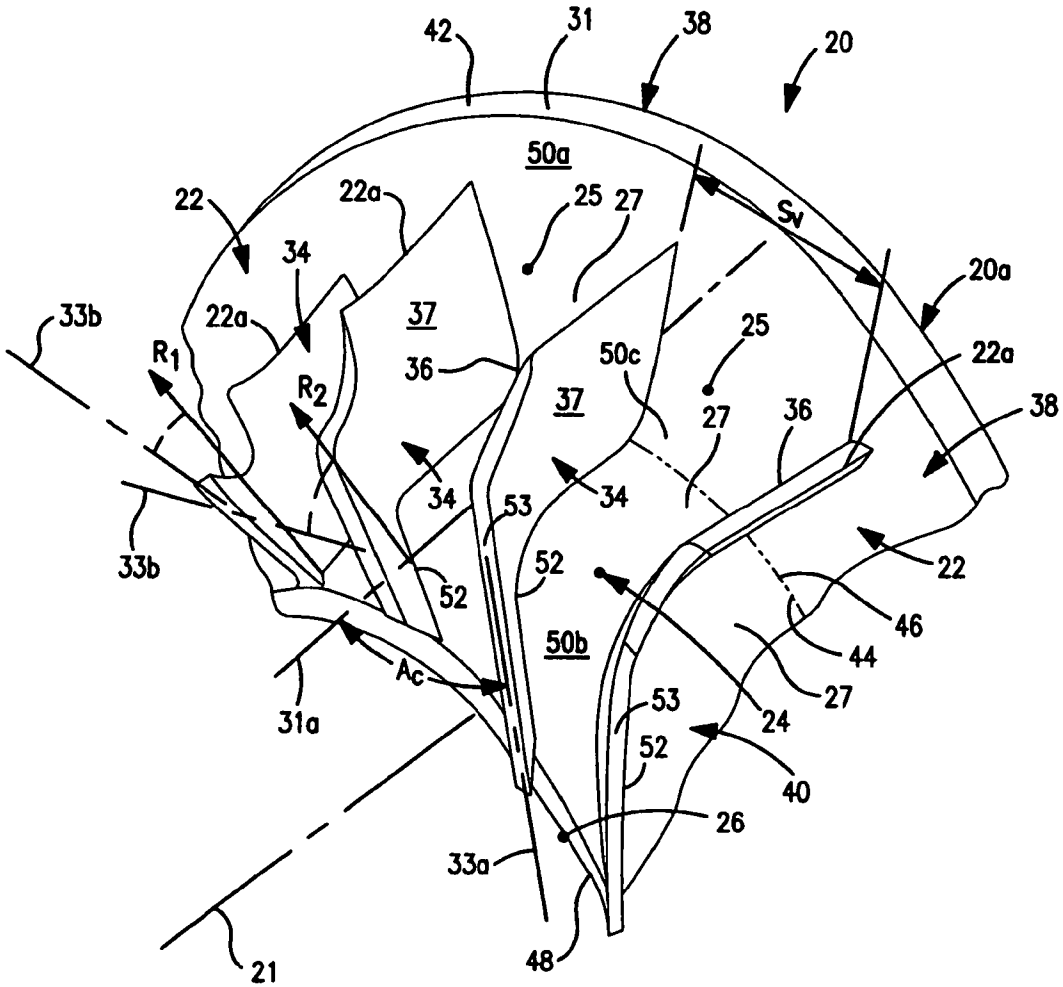
FIG. 13 is an enlarged, broken-away perspective view of the fluid deflector, shown without the shroud member.
Figure 14:
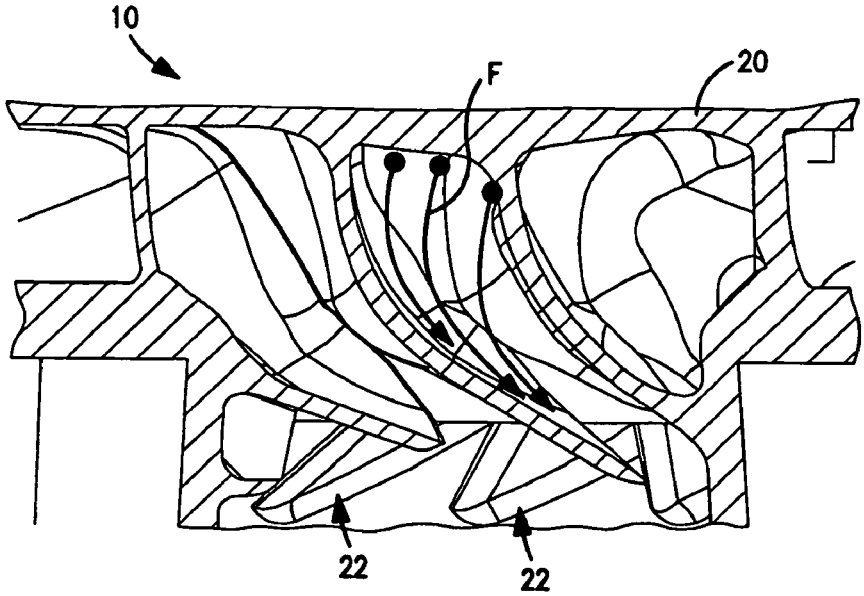
FIG. 14 is a duplicate view of FIG. 10, shown with flow paths through one flow channel.
Figure 15:
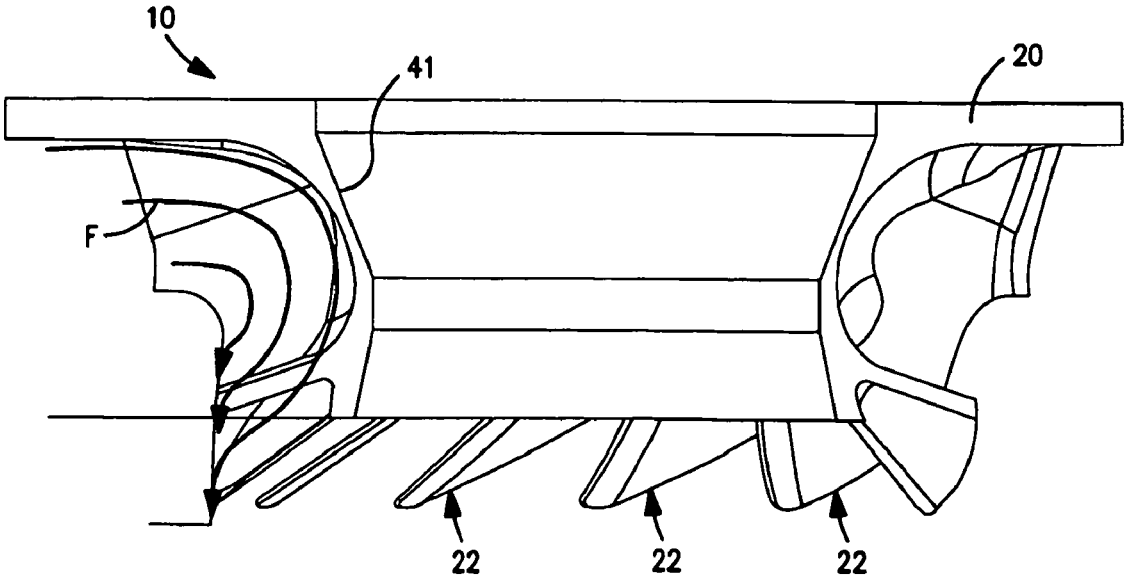
FIG. 15 is a duplicate view of FIG. 11, shown with flow paths through one flow channel.
Figure 16:
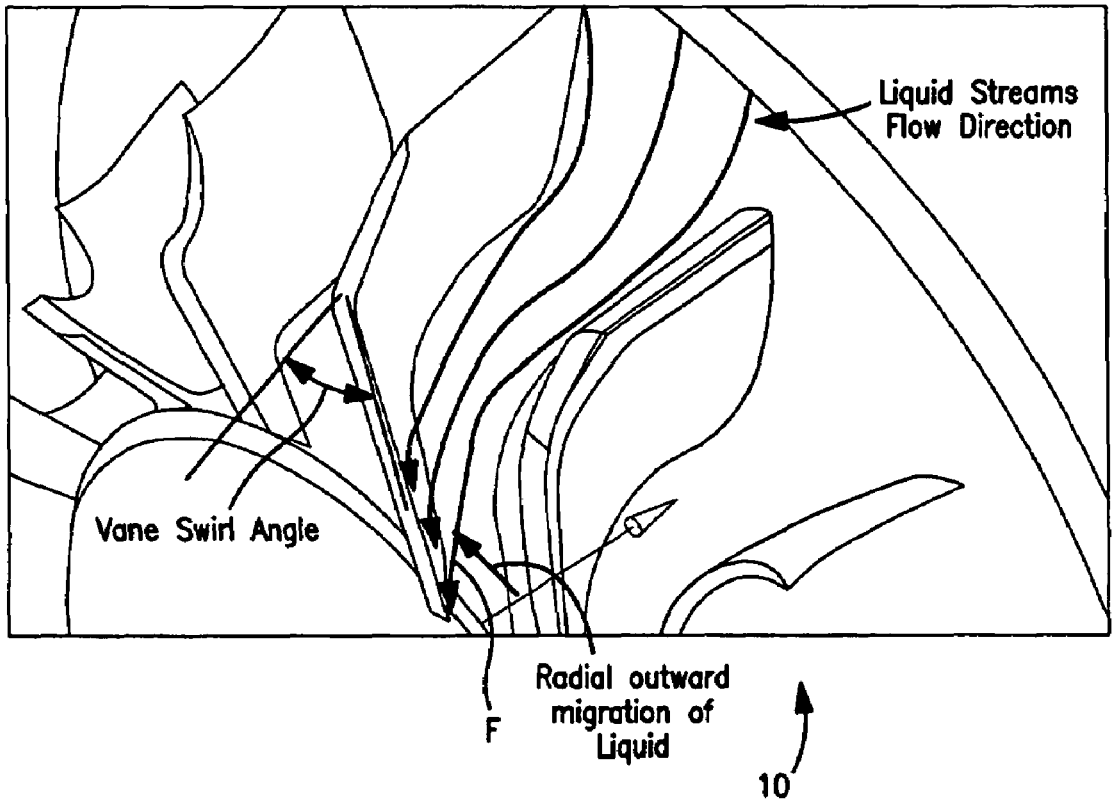
FIG. 16 is a more detailed view of FIG. 16, shown with flow paths through one flow channel.

Further, each vane body 34 is at least partially generally bended or curved so as to extend at least partially circumferentially about the base axis 21. That is, each vane body 34 is generally bended such that the body second section 34*b* is angled with respect to the body first section 34*a* so as to extend in a generally circumferential direction with respect to the axis 21, as described above. More specifically, as shown in FIG. 13, each vane body 34 is formed and arranged on the base 20 such that the vane radial portion 31 has a lateral centerline 31*a* that extends generally parallel with the axis 21 (i.e., between vane side edges 52, 53 as described below). Further, the vane axial portion 33 has a longitudinal centerline 33*a* that defines an angle AC with the respect to the radial portion centerline 31*a* (and thus the base axis 21), which is preferably about sixty degrees (60°).

As such, the body curvature (and orientation as described below) causes fluid flow F contacting the vane body 34 to be "turned" within the associated flow channels 24 so as to be directed generally radially outwardly from and circumferentially about the base axis 21 and toward the wall inner surface 17. Also, by having a curved/bended body 34 as described below, each vane axial portion 33 generally "overlaps" an inner portion of one fluid channel 24 partially defined by the vane 22, preferably by at least one half of the spacing or pitch $S_V$ (FIG. 13) between the vanes 22, such that the channel outlet 26 is spaced laterally or circumferentially from the inlet 25. As such, fluid entering generally centrally through a channel inlet 25 cannot pass through without contacting at least the vane 22 which extends across the flow channel 24, which is preferably a pressure surface of the vane 22 as described below.

Furthermore, all of the vane bodies 34 of the plurality of vanes 22 are preferably arranged on the base 20 so as extend circumferentially in the same one of two opposing angular directions $D_1$ or $D_2$ (depicted in the $D_1$ direction—see FIG. 8) about the base axis 21. As such, the plurality of vanes 22 are collectively configured to direct fluid flow contacting each vane 22 to generally swirl in a circulating mass in the one angular direction $D_1$, $D_2$ about the base axis 21. However, the deflector 10 may alternatively be constructed such that some vanes 22 are circumferentially oriented in one angular direction $D_1$, $D_2$ and the remaining are orientated in the opposing direction $D_2$, $D_1$ (not preferred), causing the fluid stream F to flow in a turbulent stream.

Referring to FIGS. 2, 3, 6, 7, 10 and 13, the base 20 is preferably generally circular and radially symmetric about the axis 21 and includes a generally disk-like outer portion 38 providing the base radial portion 20*a* and a generally tubular inner portion 40 providing the base axial portion 20*b* and having a central bore 41. The disk-like or disk portion 38 is generally shaped like a circular ring, has a circular outer circumferential edge 42 providing the body outer edge 30 described above, and further has an inner circumferential edge 44 spaced radially inwardly from the outer edge 30. The disk portion 38 is preferably fixedly connected with the casing 2 such that the fluid deflector 10 is immovably mounted within a casing chamber 3, as shown in FIG. 2.

Figure 10:
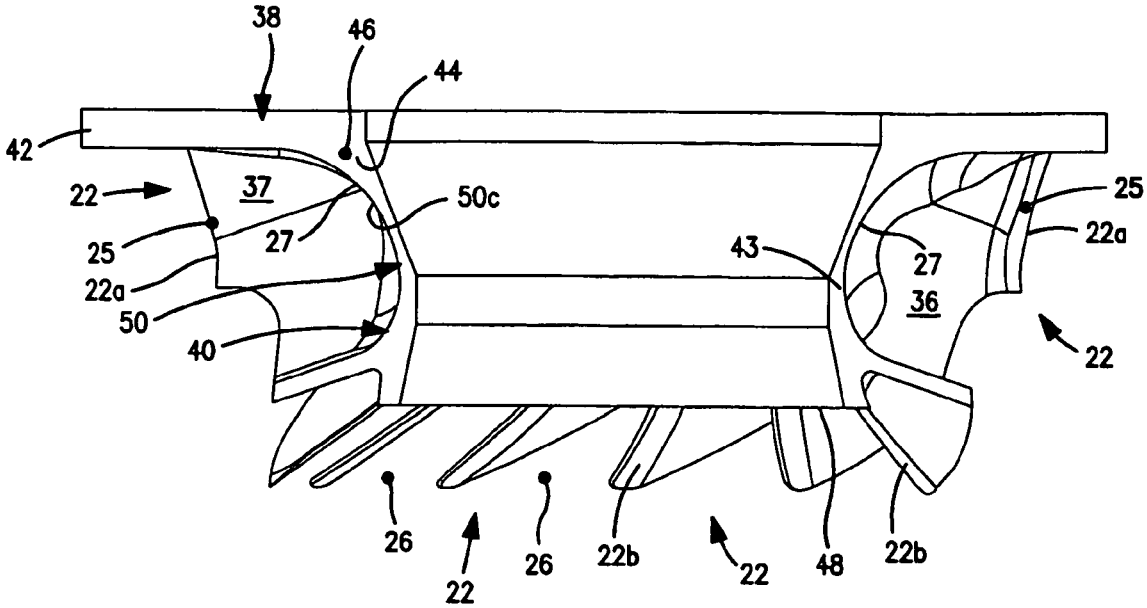
FIG. 10 is an axial cross-section view of the fluid deflector shown without the shroud member.
Figure 11:
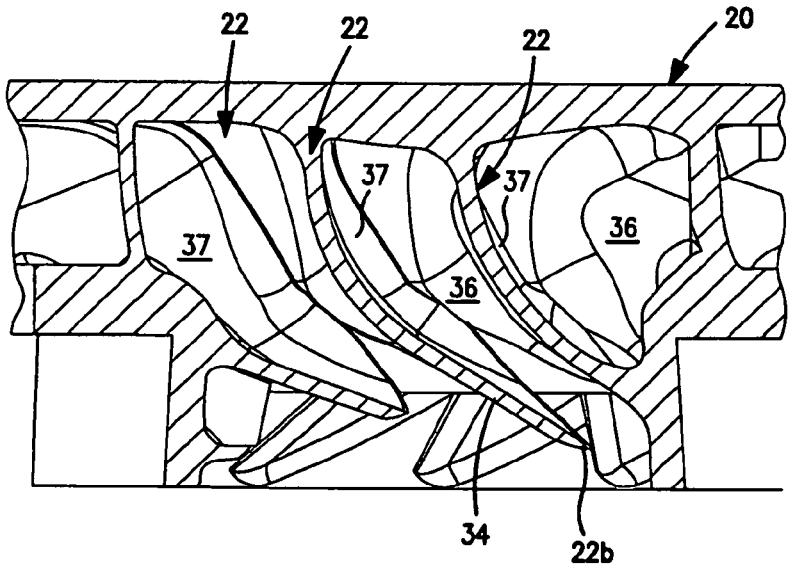
FIG. 11 is a cross-section view of the fluid deflector taken through a plane spaced from and parallel to a base axis.

Further, the generally tubular inner portion or "hub" portion 40 is generally circular and has a first axial end 46 connected with, preferably integrally formed with, the disk inner edge 44 and an opposing, second or outer axial end 48 spaced axially from the disk portion 38. The base hub portion 40 is at least partially disposeable within the separator interior chamber 17, such that fluid contacting the base portion 20 is directed into the chamber 17 by the hub portion 40. As best shown in FIGS. 2 and 10, the hub portion 40 preferably has a generally concave outer surface portion 43 extending axially between the two hub ends 46, 48, such that the base flow surface 27 of each flow channel 24 extends radially inwardly and then radially outwardly in a direction toward the channel outlet 26. As such, fluid contacting or flowing along the base flow surfaces 27 at/through the concave surface section 43 is directed generally radially outwardly from the hub second, outer end 48.

With the preferred two-portion structure described above, the base outer surface 23 is generally "complex-shaped" and has a generally radial section 50*a* extending generally radially on the base outer disk portion 38 and a generally circumferential section 50*b* extending generally axially on the base inner tubular portion 40, which includes the concave surface portion 43. The two base surface sections 50*a*, 50*b* are joined or blended through a generally concavely curved section 50*c* at the intersection or conjunction of the two base portions 38, 40. Further, the vanes 22 are connected with, and preferably integrally formed with, the base outer surface 50, such that the vanes 22 generally follow the contour of the base outer surface 50. Specifically, each vane radial portion 31 extends generally radially between the disk portion outer and inner edges 42, 44 and the connected vane axial portion 33 extends generally axially (and circumferentially) between the hub portion inner and outer axial ends 46, 48.

Referring to FIGS. 3, 6, 12 and 13, each vane 22 is configured such that the one channeling surface 36 is a suction surface and the other channeling surface 37 is a pressure surface. Each vane suction surface 36 faces generally toward the pressure surface 36 of one of the two adjacent vanes 22 such that the facing suction and pressure surfaces 36, 37 partially bound one of the plurality of flow channels 24. Further, each vane body 34 is preferably generally curved, as discussed above, such that the suction surface 36 of one vane 22 is configured to direct fluid onto the facing pressure surface 27 of one adjacent vane 22. More specifically, each vane body 34 has a generally uniform thickness $t_B$ and is formed such that the suction surface 36 is generally convex and the pressure surface 27 is generally concave. As such, fluid (particularly liquid) contacting the suction surface 36 is directed generally away or deflected from the surface 36 and toward the pressure surface 37, and fluid contacting the pressure surface 37 tends to be retained to flow therealong. Furthermore, each vane 22 is angled with respect to the base 20 such that the pressure surface 37 of the vane 22 faces generally toward the separator wall inner surface 16, as described in further detail below.

Figure 12:
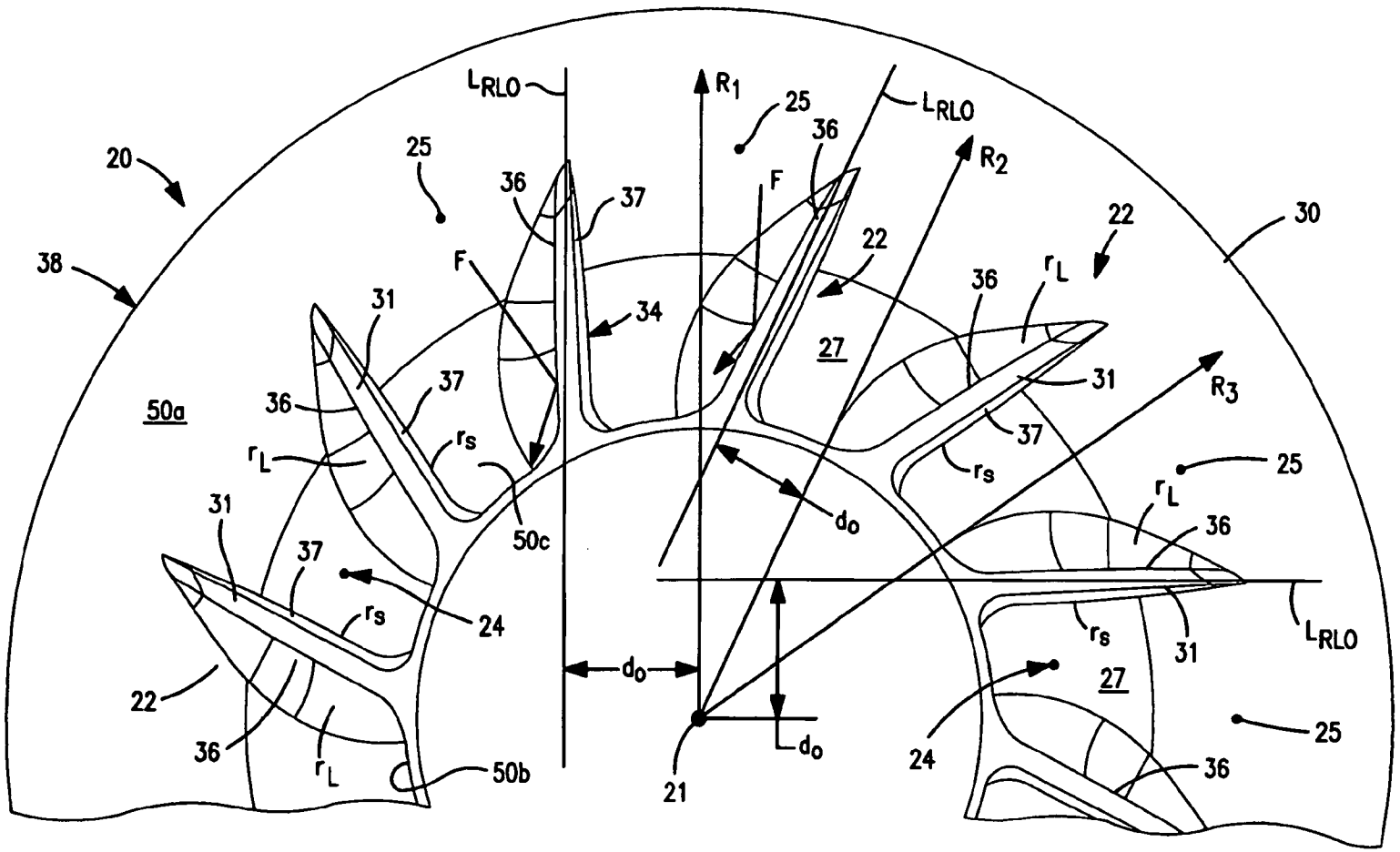
FIG. 12 is an enlarged, broken-away radial cross-sectional view of the fluid deflector.

As best shown in FIG. 12, each vane 22 is preferably arranged or oriented on the base 20 such that the vane radial portion 31 only extends generally radially with respect to the base axis 21 and not substantially or precisely radially. More specifically, each vane radial portion 31 is generally angled with respect to radial lines $R_N$ (e.g., $R_1$, $R_2$, etc.) through the base axis 21, such that a longitudinal centerline $L_{RLO}$ of the radial portion 31 is spaced or offset by a perpendicular distance $d_O$ from base axis 21, so that the vane suction surface 36 faces generally toward the base outer circumferential perimeter or edge 30 (i.e., toward the associated channel inlet 25). As such, fluid flowing through one of the two inlets 25 associated with each vane 22 contacts the vane suction surface 36 and is deflected generally toward the facing pressure surface 37 of one of the two adjacent vanes 22, as depicted in FIG. 12.

Figure 3:
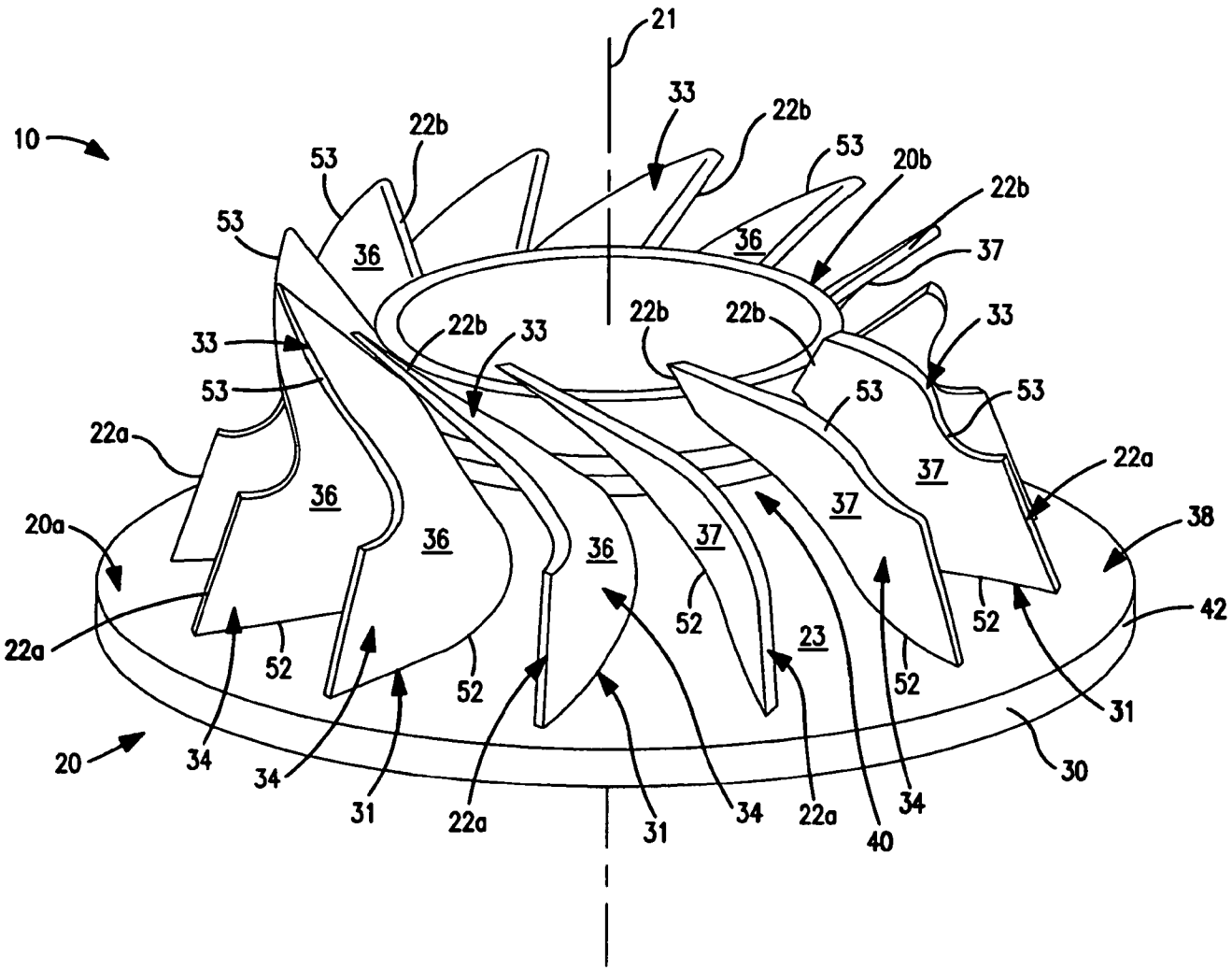
FIG. 3 is a perspective view of the fluid deflector, shown without a base shroud member.
Figure 4:
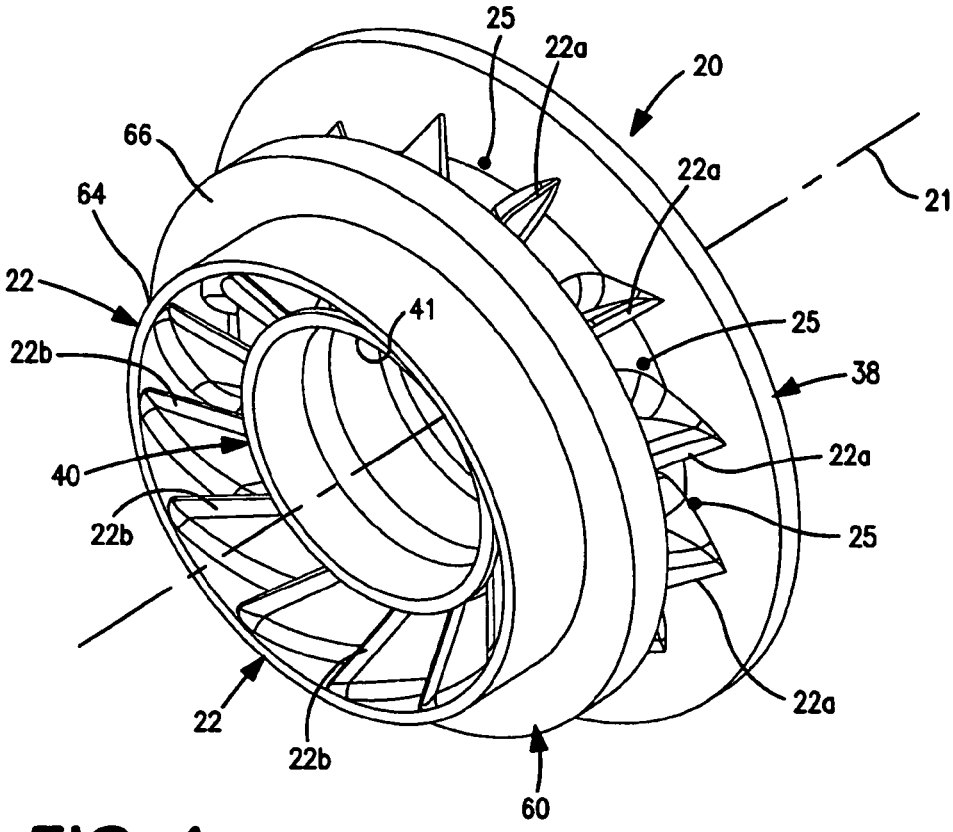
FIG. 4 another perspective view of the fluid deflector, shown with the base shroud member.
Figure 5:
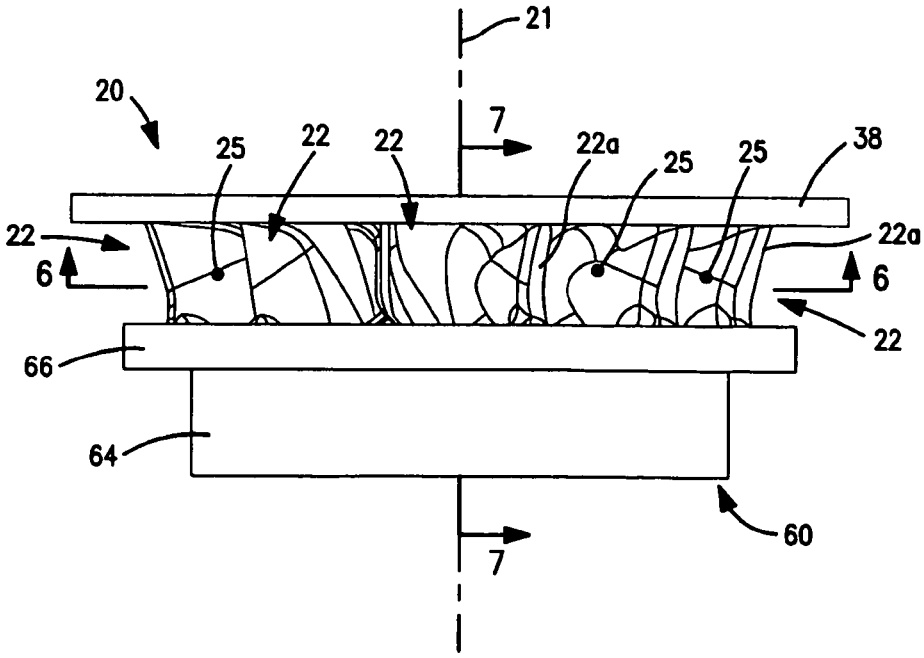
FIG. 5 is a radial side plan view of the fluid deflector.
Figure 6:
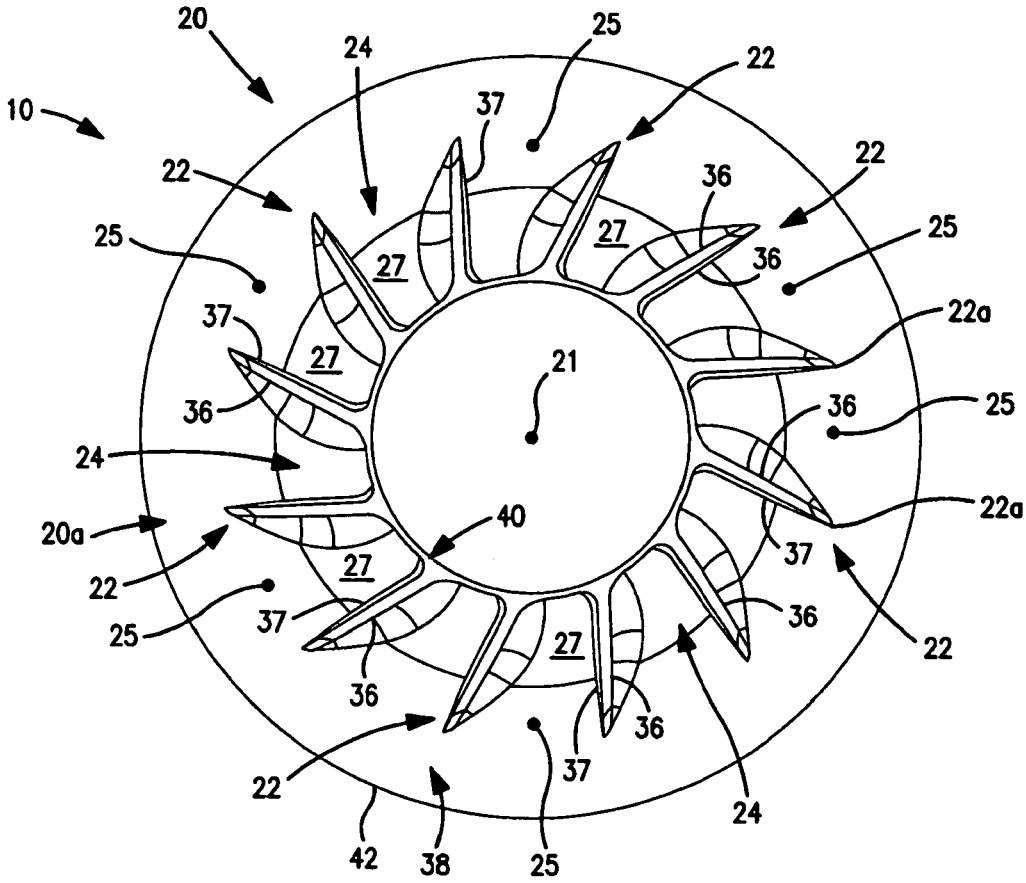
FIG. 6 is a radial cross-sectional view of the fluid deflector taken through line 6-6 of FIG. 5.
Figure 7:
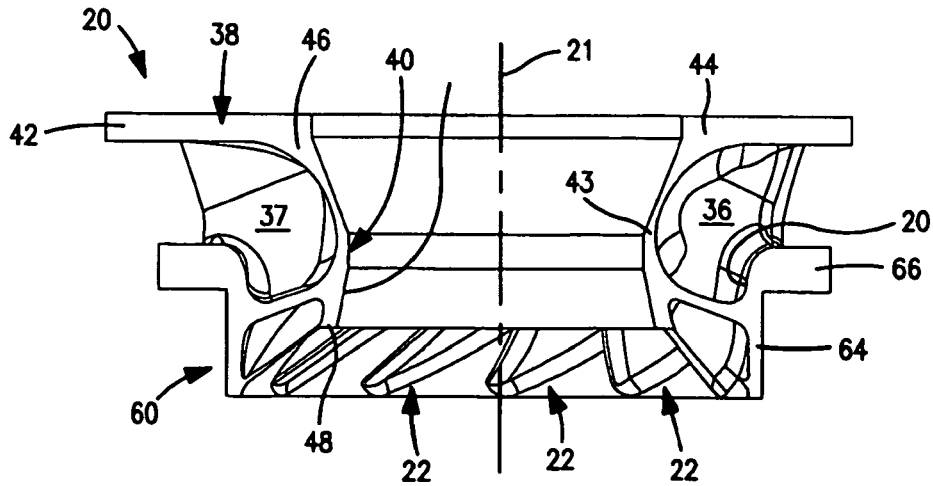
FIG. 7 is an axial cross-sectional view of the fluid deflector taken through line 7-7 of FIG. 5.
Figure 8:
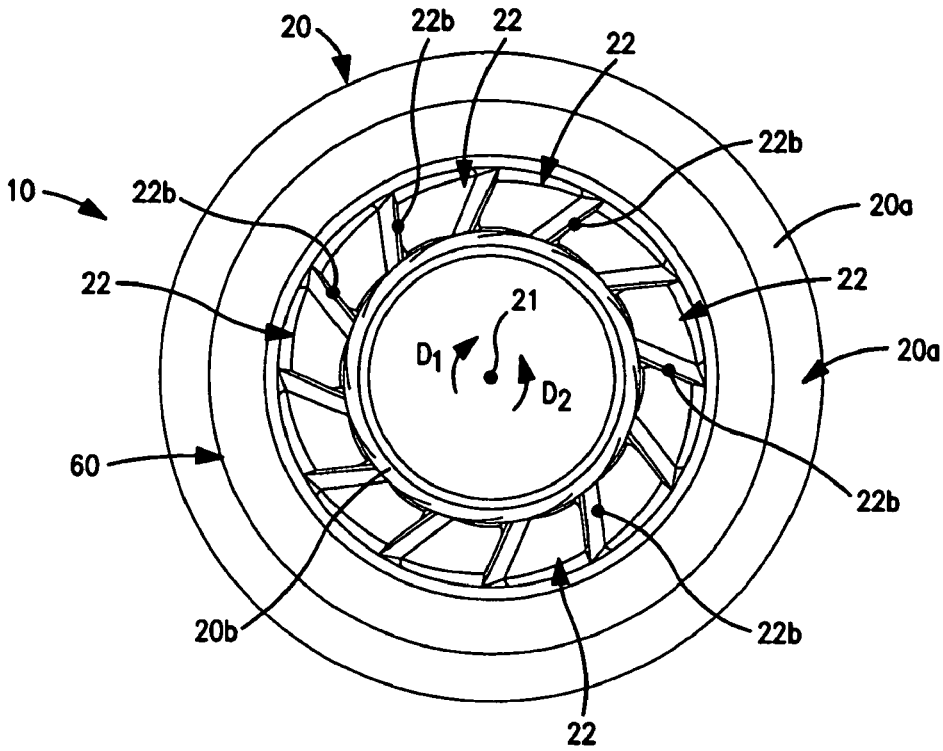
FIG. 8 is an axial front plan view of the fluid deflector.

Referring to FIGS. 2, 3, and 13, each vane body 34 also has first and second side edges 52, 53 extending generally longitudinally between the vane inlet and outlet ends 22*a*, 22*b*. The first edge 52 is connected with the base outer surface 50 and the second edge 53 is spaced from the base 20 (and connected with a base shroud 60 described below), the second edge 53 extending generally parallel with the first side edge 52. Preferably, the vane first side edges 52 are connected or joined with the base 20 such that a relatively large fillet radius $r_L$ extends between the each vane suction surface 36 and the base outer surface 50, but a rather small fillet radius $r_S$ extends between each pressure surface and the base surface 50, as indicated in FIG. 12. As such, the large fillet radius $r_L$ further assists the channeling or direction of fluid contacting each vane suction surface 36 toward the facing pressure surface 37.

Referring particularly to FIG. 13, each vane body 34 is preferably angled with respect to at least the outer surface section 50*b* of the base tubular portion 40 such that the vane second side edge 53 is angled or offset circumferentially with respect to the vane first side edge 52 (and thus also the base surface section 50*b*) so that the vane pressure surface 37 faces generally away from the base axis 21 in order to direct liquid flowing on the pressure surface 37 generally radially outwardly. In other words, at least the axial portion 33 of each vane 22 is angled with respect to the base surface section 50*b* such that a lateral centerline 33*b* extending centrally through the first and second edges 52, 53 intersects with radial lines $R_N$ (e.g., $R_1$, $R_2$, etc.) through the base axis 21 and is nonintersecting with (i.e., spaced perpendicularly from) the base axis 21, so that the vane pressure surface 37 faces generally toward the separator wall inner surface 17.

Referring to FIGS. 2, 4, 5, 7 and 8, the fluid deflector 10 preferably further comprises a base shroud member 60 including a generally tubular portion. 64 spaced radially outwardly from the base tubular portion 40 and a generally annular portion 66 spaced axially from the base disk portion 38. Each of the plurality of vanes 22 is connected with the shroud member 60, specifically the second side edges 53 thereof, such that each vane radial portion 31 extends generally axially between the base disk portion 38 and the shroud member annular portion 66 and each vane axial portion 33 extends generally radially between the base tubular portion 40 and the shroud member tubular portion 64. Although each vane 22 is preferably connected with or attached with both the base 20 and the shroud member 60, most preferably integrally formed with both, the vanes 22 may alternatively be connected with only the shroud member 60, such that the vane first side edges 52 are merely disposed against the base surface 23, or may be connected only with the base 20 so that the second side edges 53 are disposed against, but unconnected with, the shroud 60. Further, the shroud member,60 has an inner surface 66 partially bounding the plurality of flow channels 24, as described above, and opposing end surfaces 67*a*, 67*b* which are separately disposeable against the preferred inner and wall sections 14*a*, 14*b* of the separator enclosed wall 14, as depicted in FIG. 2. Furthermore, although the shroud member 60 is preferred, the fluid deflector 10 may be constructed without the shroud member 66 and will still function generally as described herein.

Figure 9:
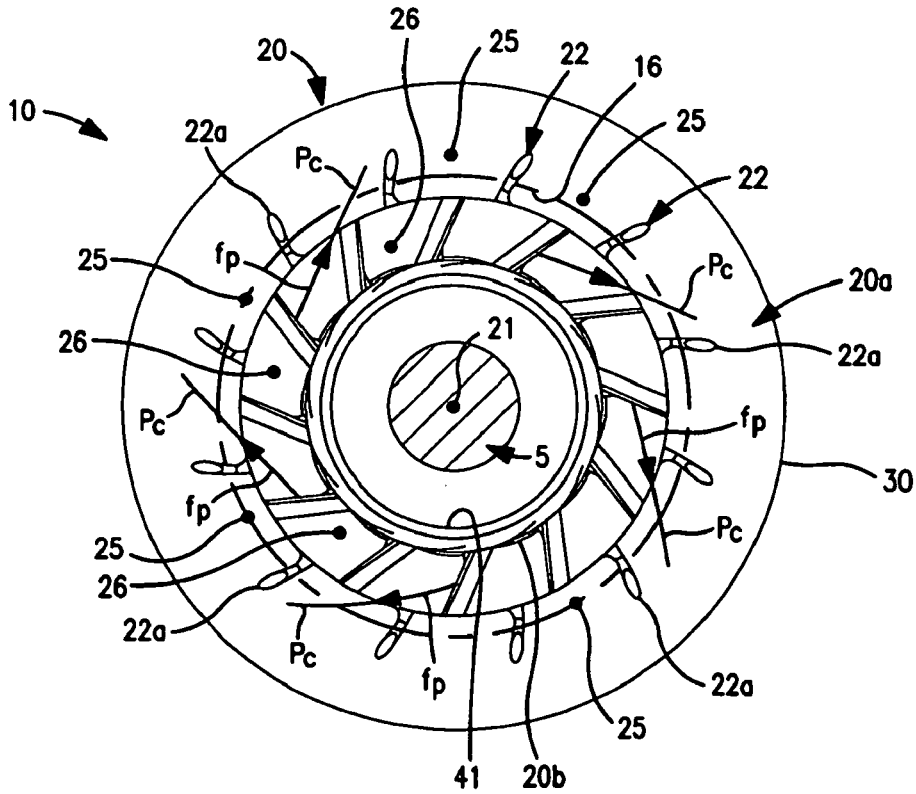
FIG. 9 is an axial front plan view of the fluid deflector, shown without the shroud member and with a separator wall inner surface in phantom.

Referring to FIGS. 2 and 9, the fluid deflector 10 is preferably used with a separator-compressor device 2 that further includes a drive rotor or shaft 5 extending through the casing 2 and a rotary separator 6 mounted on the shaft 5. The rotary separator 6 preferably includes a generally tubular drum 7 mounted on the shaft 5 and disposed within the separator wall 14 such that the separation chamber 17 is generally annular. As such, the bore 41 of the base hub portion 40 is preferably sized to receive the shaft 5 with clearance, such that the shaft 5 is rotatable within the base 20 (and deflector 10) while the base 20 remains stationary. Most preferably, a portion of the rotary separator drum 7 is disposed within the base opening 54, the opening 54 being sized such that the drum 7 also rotates within the immovable deflector base 20.

It will be appreciated by those skilled in the art that changes could be made to the embodiments described above without departing from the broad inventive concept thereof. It is understood, therefore, that this invention is not limited to the particular embodiments disclosed, but it is intended to cover modifications' within the spirit and scope of the present invention as generally defined in the appended claims.

We claim:

1. A fluid deflector for a fluid separator, comprising:

a base disposable proximate an open end of a substantially enclosed wall of the fluid separator and having a base central axis being substantially collinear with a separator central axis, wherein the substantially enclosed wall has an inner circumferential separation surface extending circumferentially about the base central axis so as to define an interior separation chamber; and a plurality of vanes spaced circumferentially about the base central axis, connected with or disposed against the base and extending radially outward therefrom, the plurality of vanes being rotationally stationary with respect to the separator central axis and being configured to direct fluid radially outward toward the inner circumferential separation surface.

2. The fluid deflector as recited in claim 1, wherein the base and the plurality of vanes define a plurality of flow channels, each of the plurality of flow channels being bounded by a separate one of a plurality of pairs of adjacent vanes of the plurality of vanes and having a channel inlet and a channel outlet, each of the plurality of vanes being configured to direct flow through at least one channel such that fluid flows radially inward from the channel inlet toward the channel outlet and circumferentially and radially outward from the channel outlet.

3. The fluid deflector as recited in claim 2, wherein the base has an outer surface facing toward the substantially enclosed wall, each of the plurality of vanes extending outward from the outer surface, each of the plurality of flow channels being partially bounded by a separate one of a plurality of flow sections of the base surface.

4. The fluid deflector as recited in claim 3, wherein the base includes a body with a tubular hub portion having first and second ends spaced apart along the base central axis and a disk-shaped portion extending radially outward from the first end of the hub portion, the hub portion being at least partially disposed within the interior separation chamber and each base flow section extending radially along the disk-shaped portion and axially along the hub portion so that fluid contacting a base flow section is directed radially inward and then axially and into the interior separation chamber toward the inner circumferential separation surface.

5. The fluid deflector as recited in claim 1, wherein each of the plurality of vanes includes an elongated body extending at least partially along the base central axis and having first and second ends and opposing channeling surfaces extending between the first and second ends, wherein the first end is spaced axially outward from the open end of the substantially enclosed wall and the second end is spaced axially inward from the open end of the substantially enclosed wall so as to be disposed at least partially within the interior separation chamber, each of the channeling surfaces being configured to direct fluid contacting the elongated body proximal to the first end to flow radially inward and then simultaneously axially and radially outward beyond the second end.

6. The fluid deflector as recited in claim 5, wherein the elongated body of each of the plurality of vanes is at least partially curved so as to extend at least partially circumferentially about the base central axis such that fluid flow is directed radially outward from and circumferentially about the base central axis and toward the interior separation surface, and the elongated body of each of the plurality of vanes has first and second side edges each extending between the first and second ends of each of the plurality of vanes, the first side edge being disposed against the base and the second side edge being spaced from the base, the second side edge extending substantially parallel with the first side edge.

7. The fluid deflector as recited in claim 5, wherein the elongated body of each of the plurality of vanes extends at least partially circumferentially in the same one of two opposing angular directions about the base central axis, wherein the plurality of vanes are configured to direct flow contacting at least two of the vanes to swirl in one of two opposing angular directions about the base central axis.

8. The fluid deflector as recited in claim 6, wherein the base includes a tubular portion with an outer circumferential surface, the first side edge of each of the plurality of vanes being connected with the outer circumferential surface, and being angled with respect to the outer circumferential surface such that the second side edge of each of the plurality of vanes is offset circumferentially with respect to the first side edge.

9. The fluid deflector as recited in claim 6, further comprising a tubular shroud spaced radially outward from the tubular portion of the base, the second side edge of each of the plurality of vanes being connected with the shroud.

10. The fluid deflector as recited in claim 5, wherein each of the plurality of vanes is disposed between two adjacent vanes of the plurality of vanes, one of the opposing channeling surfaces is a suction surface and the other opposing channeling surface is a pressure surface, each suction surface facing toward the pressure surface of one of the two adjacent vanes such that the facing suction and pressure surfaces partially bound one of the plurality of flow channels, each of the plurality of vanes being angled such that the pressure surface of each vane faces toward the inner circumferential separation surface and each suction surface is configured to direct fluid contacting the suction surface toward the facing pressure surface, the suction surface facing toward an outer circumferential perimeter of the base so that fluid contacting the suction surface is deflected toward the facing pressure surface of one of the two adjacent vanes.

11. The fluid deflector as recited in claim 1, wherein the fluid separator further comprises:

a flow port adjacent to the open end of the substantially enclosed wall, wherein each of the plurality of vanes has a first end located at least proximal to the flow port and a second end spaced axially and radially inwardly from the first end and disposable within the interior separation chamber such that fluid contacting the plurality of vanes is directed to flow radially inwardly from the first end of each of the plurality of vanes, axially into the interior separation chamber, and radially outwardly from the second end of each of the plurality of vanes toward the inner surface of the substantially enclosed wall; and a flow passage extending along the separator central axis, the flow port fluidly connecting the flow passage with the interior separation chamber, wherein at least one of the base and the plurality of vanes is configured to deflect fluid flowing in a first axial direction through the flow passage to flow in an opposing second axial direction into the interior separation chamber.

12. The fluid deflector as recited in claim 1, wherein:

the substantially enclosed wall of the fluid separator is an inner wall and has an outer circumferential surface, wherein the fluid separator further includes another substantially enclosed wall with an inner circumferential surface being spaced radially outward from the outer circumferential surface of the inner wall so as to define an annular flow channel; and the base is spaced axially from the inner wall end and extends radially toward the outer circumferential surface and has a portion disposed within the interior separation chamber such that fluid flowing through the annular flow channel contacts at least one of the base and at least one of the plurality of vanes so as to be directed radially and then axially and circumferentially into the interior separation chamber.

13. The fluid deflector as recited in claim 12, wherein the fluid separator further includes a rotatable shaft and a rotary separator mounted on the shaft and disposed within the interior separation chamber, the base having a central opening sized to receive the rotatable shaft with clearance such that the rotatable shaft is rotatable with respect to the base.

14. The fluid deflector as recited in claim 13, wherein the fluid separator includes a casing, the outer circumferential surface being immovably mounted within the casing, the base is fixedly connected with the outer circumferential surface, and a portion of the rotary separator is disposed within the central opening of the base, the central opening of the base being sized such that the rotary separator is rotatable with respect to the base.

15. A fluid separator comprising:

a housing having an interior chamber and an inlet passage extending into the interior chamber;

an enclosed wall disposed within the interior chamber and having an end surface and an inner circumferential surface at least partially defining a separation chamber; and a fluid deflector disposed within the interior chamber and including a rotationally stationary base with a central axis, the base being spaced from the wall end surface so as to define a radial port configured to fluidly connect the inlet passage with the separation chamber, and a plurality of vanes spaced circumferentially about the base central axis, extending radially outward from the base and being rotationally stationary with respect to the central axis, each of the plurality of vanes being configured to direct fluid outward, toward the inner circumferential surface of the enclosed wall such that at least a portion of at least one of liquid and relatively dense gas within a fluid directed onto the inner circumferential surface of the enclosed wall is separated from the fluid.

16. The fluid separator as recited in claim 15, further comprising:

a shaft disposed within the interior chamber so as to be rotatable about the central axis; and a rotary separator mounted to the shaft and having an outer surface spaced radially inward from the wall inner circumferential surface such that the separation chamber is an annular primary chamber, the rotary separator having an inner surface extending about the shaft so as to define an inner separation chamber and at least one outlet passage fluidly connecting the inner separation chamber with the primary chamber.

17. The fluid separator as recited in claim 15, wherein the base and the plurality of vanes define a plurality of flow channels, each of the plurality of flow channels being bounded by adjacent vanes of the plurality of vanes and having an channel inlet and an channel outlet, each of the plurality of vanes being configured to direct flow through at least one of the plurality of flow channels such that fluid flows radially inward from the channel inlet toward the channel outlet and circumferentially and radially outward from the channel outlet.

18. The fluid separator as recited in claim 17, wherein the base includes a body with a tubular hub portion having first and second ends spaced apart along the central axis and a disk-shaped portion extending radially outward from the first end of the hub portion, the hub portion being at least partially disposable within the separation chamber and each of the plurality of flow channels extending radially along the disk-shaped portion and axially along the hub portion so that fluid contacting at least one of the plurality of flow channels is directed radially inward and then axially and into the separation chamber.

19. The fluid separator as recited in claim 15, wherein each of the plurality of vanes includes an elongated body having first and second ends and opposing channeling surfaces extending between the first and second ends, the channeling surface of each of the plurality of vanes being configured to direct fluid contacting the elongated body of a respective one of the plurality of vanes, proximal to the first end of the body to flow radially and then both axially and radially outwardly beyond the second end.

20. A compressor comprising:

a casing having an interior chamber and an inlet passage extending into the chamber;

a shaft disposed within the casing chamber so as to be rotatable about a central axis;

a least one impeller mounted on the shaft;

a wall disposed within casing chamber and having an end surface and an inner surface extending circumferentially about the central axis and spaced radially outward from the shaft, the inner surface at least partially defining a separation chamber; and a fluid deflector disposed within the separation chamber between the wall end surface and the impeller, the fluid deflector including:

a base with a central axis, the base being spaced from the wall end surface so as to define a radial port configured to fluidly connect the inlet passage with the separation chamber; and a plurality of vanes spaced circumferentially about the base central axis, each vane being configured to direct a fluid contacting the vane toward the wall inner surface such that at least a portion of at least one of liquid and relatively dense gas within the fluid directed onto the wall inner surface is separated from the fluid.

* * * * *